US008182363B2

(12) United States Patent
Bezilla et al.

(10) Patent No.: US 8,182,363 B2
(45) **Date of Patent: *May 22, 2012**

(54) GOLF CLUB HEAD AND REMOVEABLE WEIGHT

(75) Inventors: Stephanie Bezilla, Carlsbad, CA (US); Thomas Orrin Bennett, Carlsbad, CA (US); Stephen S. Murphy, Carlsbad, CA (US); Scott A. Knutson, Escondido, CA (US); Denise T. Herman, Carlsbad, CA (US); Gery M. Zimmerman, Fallbrook, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/845,040

(22) Filed: Jul. 28, 2010

(65) Prior Publication Data

US 2010/0311520 A1 Dec. 9, 2010

Related U.S. Application Data

(63) Continuation of application No. 12/130,435, filed on May 30, 2008, now Pat. No. 7,771,290.

(51) Int. Cl.
*A63B 53/04* (2006.01)
*A63B 53/06* (2006.01)

(52) U.S. Cl. ..... 473/335; 473/345

(58) Field of Classification Search ..... 473/324–350
See application file for complete search history.

(56) References Cited

U.S. PATENT DOCUMENTS

| | | | |
|---|---|---|---|
| 1,167,106 | A | 1/1916 | Palmer |
| 3,466,047 | A | 9/1969 | Rodia et al. |
| 3,652,094 | A | 3/1972 | Glover |
| 3,692,306 | A | 9/1972 | Glover |
| 4,026,183 | A | 5/1977 | Bart |
| 4,043,563 | A | 8/1977 | Churchward |
| 4,052,075 | A | 10/1977 | Daly |
| 5,154,424 | A | 10/1992 | Lo |
| 6,089,994 | A | 7/2000 | Sun |
| 6,773,360 | B2 | 8/2004 | Willett et al. |
| 7,121,956 | B2 | 10/2006 | Lo |
| 7,186,190 | B1 | 3/2007 | Beach et al. |
| 7,223,180 | B2 | 5/2007 | Willett et al. |
| 7,294,065 | B2 | 11/2007 | Liang et al. |
| 7,407,447 | B2 | 8/2008 | Beach |

(Continued)

FOREIGN PATENT DOCUMENTS

| | | |
|---|---|---|
| GB | 2133295 | 7/1984 |

(Continued)

*Primary Examiner* — Alvin Hunter
(74) *Attorney, Agent, or Firm* — Michael J. Mancuso

(57) ABSTRACT

A golf club head and a removable weight that is received in a receptacle of the golf club head. The weight includes a cap and a slug. The cap is removably coupled to the receptacle and includes a recess that slidably receives a portion of the slug so that the cap and slug are able to rotate relative to each other. The slug includes an anti-rotation feature that prevents relative rotation between the slug and the receptacle.

14 Claims, 12 Drawing Sheets

U.S. PATENT DOCUMENTS

| | | | | |
|---|---|---|---|---|
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,452,285 | B2 | 11/2008 | Chao et al. | |
| 7,771,290 | B2 * | 8/2010 | Bezilla et al. | 473/335 |
| 2004/0092332 | A1 | 5/2004 | Willett et al. | |
| 2006/0100029 | A1 | 5/2006 | Lo | |
| 2006/0122004 | A1 | 6/2006 | Chen | |
| 2008/0039229 | A1 | 2/2008 | Lo | |
| 2008/0132353 | A1 | 6/2008 | Hsiao | |
| 2008/0146370 | A1 | 6/2008 | Beach | |

FOREIGN PATENT DOCUMENTS

| | | |
|---|---|---|
| JP | 10137374 | 5/1998 |
| JP | 10234902 | 9/1998 |
| JP | 10248964 | 9/1998 |
| JP | 11319167 | 11/1999 |
| JP | 2001149514 | 6/2001 |
| JP | 2006122334 | 5/2006 |
| JP | 2007313304 | 12/2007 |

* cited by examiner

GOLF CLUB HEAD AND REMOVEABLE WEIGHT

CROSS-REFERENCE TO RELATED APPLICATIONS

This application is a continuation of U.S. patent application Ser. No. 12/130,435, filed May 30, 2008, now U.S. Pat. No. 7,771,290 currently , the contents of which are incorporated in their entirety by reference herein.

FIELD OF THE INVENTION

This invention generally relates to golf club heads, and more specifically to golf club heads including a removable weight.

BACKGROUND OF THE INVENTION

Removable weights have been incorporated into golf club heads to distribute discretionary mass in order to alter the performance characteristics of the golf clubs. For example, weights may be incorporated to provide adjustability in characteristics such as swing weight, location of the center of gravity and manipulation of the moment of inertia of a particular golf club head. Various weight designs have been utilized that allow the manufacturer and/or consumer to alter the mass properties of a golf club head.

One example of a weight incorporated into a club head is described in U.S. Pat. No. 1,167,106 to Palmer for a Golf Club. Palmer describes a golf club that includes a threaded opening that receives threaded weight plugs for varying the weight of a cast metal golf club head. The threaded opening extends through a rear wall of the golf club head and receives a threaded plug which may be just long enough to fill the opening or it may extend further into the golf club head to increase the weight. The threaded opening is tapered so that the plug may be tightened to a desired depth. A disadvantage of the threaded weight plug is that it is constructed as a single piece. As a result, torque applied to the weight plug during use of the golf club is transmitted to the threaded portion and may result in the weight plug becoming disengaged, especially with repeated use.

Another example of a removable weight is described in U.S. Pat. No. 6,773,360 to Willett et al. for a Golf Club Having a Removable Weight. The removable weight includes a mass element and a fastener that extends through an aperture in the mass element. A golf club head body includes an interior cavity and a recess on a wall of the body. Inside the recess, a threaded opening is provided so that the fastener may extend through the mass element disposed in the recess and into the threaded opening to fasten the mass element in the recess. Because the fastener extends through the mass element and into a threaded opening in the recess, the size of the mass element and the structure of the recess are limited. Additionally, the mass element is visible to the user when installed so less variation is available for the mass element without detrimentally affecting the aesthetics of the club head.

It is desirable to provide a golf club head and a weight member that allows additional design freedom for the weight while creating fewer restrictions on the golf club head design.

SUMMARY OF THE INVENTION

The invention is directed to a golf club head and a removable weight. Several embodiments of the present invention are described below.

In an embodiment, a removable weight is provided for a golf club head including a receptacle. The weight generally includes a cap and a slug. The cap includes a base, a sidewall and a tool engagement feature. The sidewall extends from the base to define a recess. The tool engagement feature is included in the base so the weight can be manipulated by a user using a tool. The side wall of the cap includes an outer surface that is removably coupled to the receptacle when the weight is installed in the club head. The slug includes a retention portion and an extension portion. At least a portion of the retention portion is slidably disposed in the recess, and the extension portion includes an anti-rotation feature that engages the receptacle to prevent relative rotation between the receptacle and the slug.

In another embodiment, a golf club head includes a body and a weight. The body includes a receptacle that includes a cap portion and a seat portion. The cap portion is disposed proximate an outer surface of the body and the seat portion is spaced from the outer surface of the body by the cap portion. The weight includes a cap and a slug. The cap includes a base and a sidewall that extends from the base and defines a recess. The side wall includes an outer surface that is removably coupled to the cap portion of the receptacle. The slug includes a retention portion and an extension portion. At least a portion of the retention portion is slidably disposed in the recess and the extension portion includes an anti-rotation feature that engages the seat portion of the receptacle to prevent relative rotation between the receptacle and the slug.

In a further embodiment, a golf club head includes a body and a weight. The body includes a receptacle that includes a threaded cap portion and a seat portion. The weight includes a threaded cap, a slug and a retainer. The cap includes a base and a sidewall that extends from the base to define a recess. The cap is threadably coupled to the cap portion of the receptacle. The slug includes a retention portion and an extension portion. At least a portion of the retention portion is slidably disposed in the recess and the extension portion includes an anti-rotation feature that engages the seat portion of the receptacle to prevent relative rotation between the receptacle and the slug. The retainer extends across a sliding interface between the cap and the slug.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to a golf club head and a removable weight. The removable weight is provided for use with a golf club head to alter the mass properties of the golf club head. Several embodiments of the present invention are described below.

Figure 1:
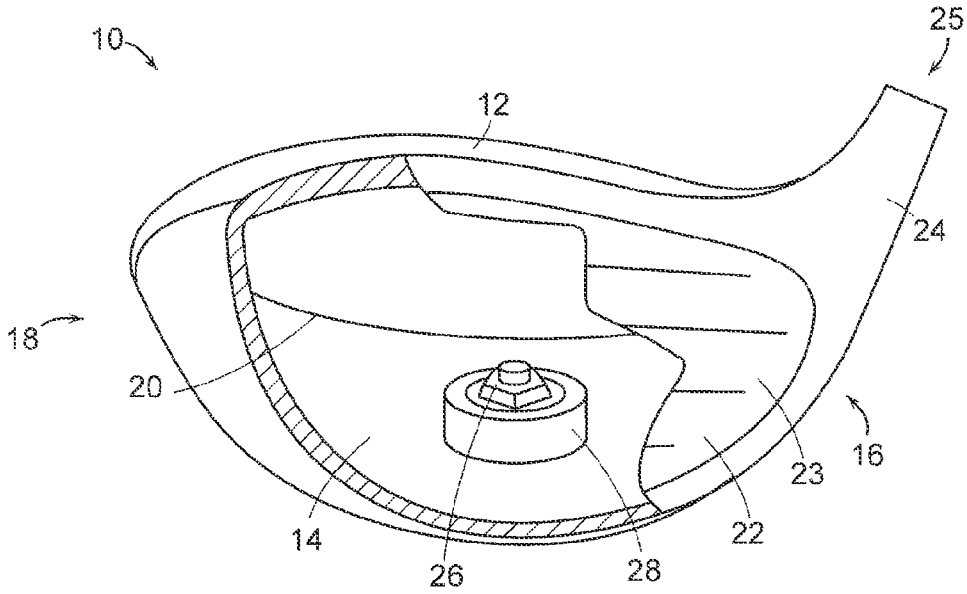
FIG. 1 is a front view of a portion of a golf club head including a weight in accordance with the present invention.
Figure 2:
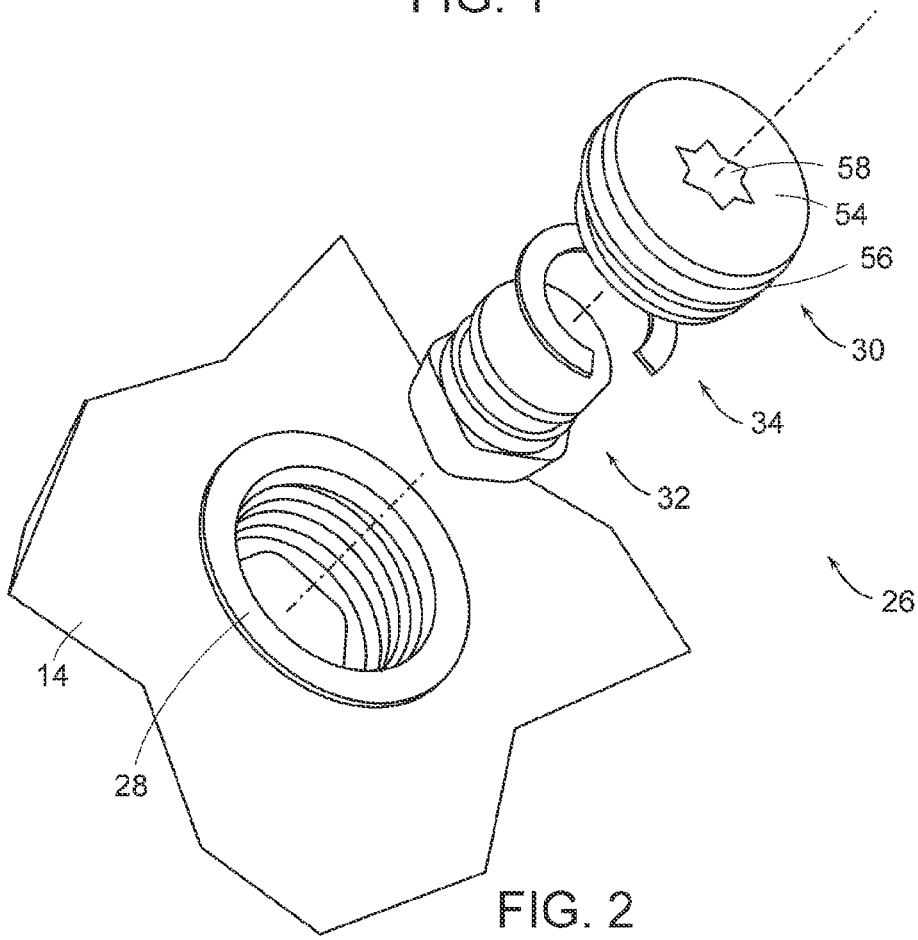
FIG. 2 is an exploded view of a portion of the golf club head of FIG. 1.

Referring to FIGS. 1 and 2 a golf club head including an embodiment of a weight in accordance with the present invention will be described. Golf club head 10 generally includes a crown portion 12, a sole portion 14, a heel portion 16, a toe portion 18, a rear portion 20, a front portion 22, a hosel 24 and a weight 26. Front portion 22 includes a striking face 23 for impacting a golf ball. Crown portion 12 extends rearward from front portion 22 and forms a top surface of club head 10. Heel portion 16, toe portion 18 and rear portion 20 combine to form side walls of club head 10 and extend generally downward from the peripheral edge of crown portion 12 to the peripheral edge of sole portion 14. Sole portion 14 extends between the lower edges of front portion 22, heel portion 16, toe portion 18 and rear portion 20.

Hosel 24 is a generally tubular member that extends outward from crown portion 12 generally adjacent the intersection of heel portion 16 and front portion 22. In a complete golf club incorporating golf club head 10, a golf club shaft is attached to golf club 10 at hosel 24. For example, an end of the shaft is received in a shaft bore 25 defined by hosel 24 and bonded to hosel 24. It should be appreciated that hosel 24 is one exemplary construction, but any hosel construction may be incorporated into club head 10.

Weight receptacle 28 is included in one of the components of club head 10 and receives weight 26. In the present embodiment, club head 10 includes a single weight receptacle 28 provided in sole portion 14. However, it should be appreciated that any number of weight receptacles may be provided in the club head and each weight receptacle 28 may have any location and orientation corresponding to any desired design attribute. For example, a plurality of weight receptacles 28 may be provided in club head 10 to allow alteration of the location of the center of gravity of club head 10. The center of gravity may be relocated in a heel to toe direction to impart draw bias or fade bias and/or in a front to rear direction to alter launch angle and spin characteristics. The weight receptacle may be constructed as an integral part of club head 10 or it may be constructed as a separate component and attached to club head 10. Additionally, in embodiments utilizing a separate receptacle component, the receptacle may be constructed as a full receptacle including both a cap portion and a seat portion, or a partial receptacle including either a cap portion or a seat portion. Furthermore, in a club head constructed from cast components, a full weight receptacle may be cast integral with the corresponding club head component.

Figure 3A:
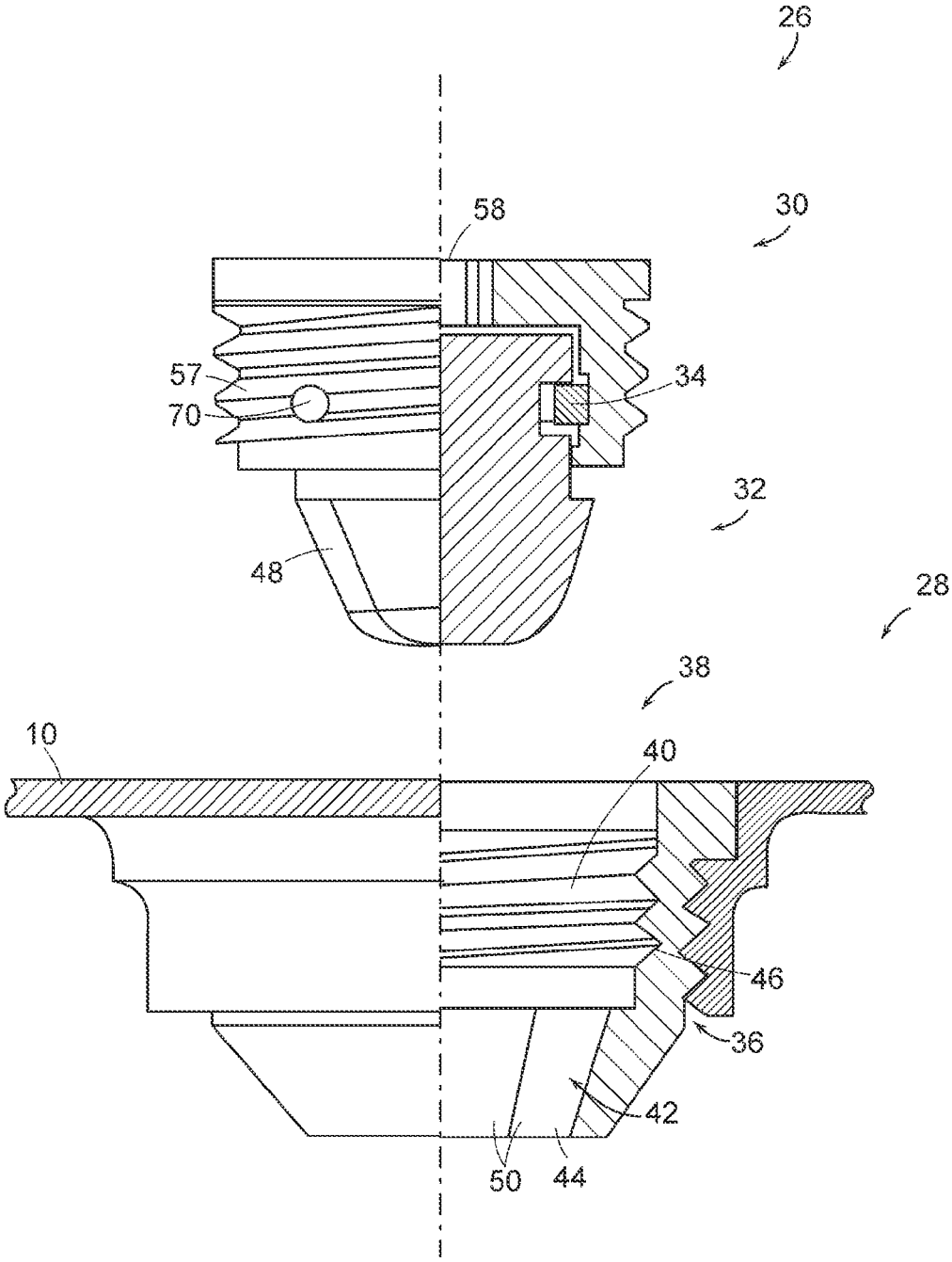
FIGS. 3A-3D are partial cross-sectional views of embodiments of a weight and a weight receptacle in a club head in accordance with the present invention.

Embodiments of full and partial weight receptacles constructed as separate components are illustrated in FIGS. 3A-3D. Referring first to FIG. 3A, weight receptacle 28 is a full receptacle that is a generally tubular or cup-shaped component that is sized and shaped to receive weight 26. In the present embodiment, weight receptacle 28 includes an outer attachment feature 36 that is used to permanently or semi-permanently attach weight receptacle 28 to a portion of club head 10. Outer attachment feature 36 may include a threaded surface, a bonding surface and/or a welding surface. As shown, weight receptacle 28 includes outer attachment feature 36, which is a threaded outer surface that is configured to engage a threaded hole included in club head 10.

Receptacle 28 includes a bore 38 that extends through a cap portion 40 and a seat portion 42. Cap portion 40 is configured to receive and to be removably attached to a cap 30 included in weight 26. An inner attachment feature 46 is included in cap portion 40 that allows cap 30 to be removably coupled to receptacle. In the present embodiment, inner attachment feature 46 is a threaded surface that engages a threaded outer surface 57 of cap 30.

Seat portion 42 of receptacle 28 is sized and shaped to receive a portion of a slug 32 that is included in weight 26. Slug portion 42 of receptacle includes an anti-rotation feature 44 that cooperates with a complementary anti-rotation feature 48 of slug 32 to prevent relative rotation between slug 32 and receptacle 28 when slug 32 is received therein. In the present embodiment, seat portion 42 includes a plurality of tapered facets 50 combined so that seat portion 42 is generally tubular and tapered and has a generally polygonal cross-sectional shape. However, it should be appreciated that the length of seat portion 42 may be reduced so that rather than including a plurality of facets seat portion 42 merely includes a polygonal opening sized to abut slug 32.

Figure 3B:
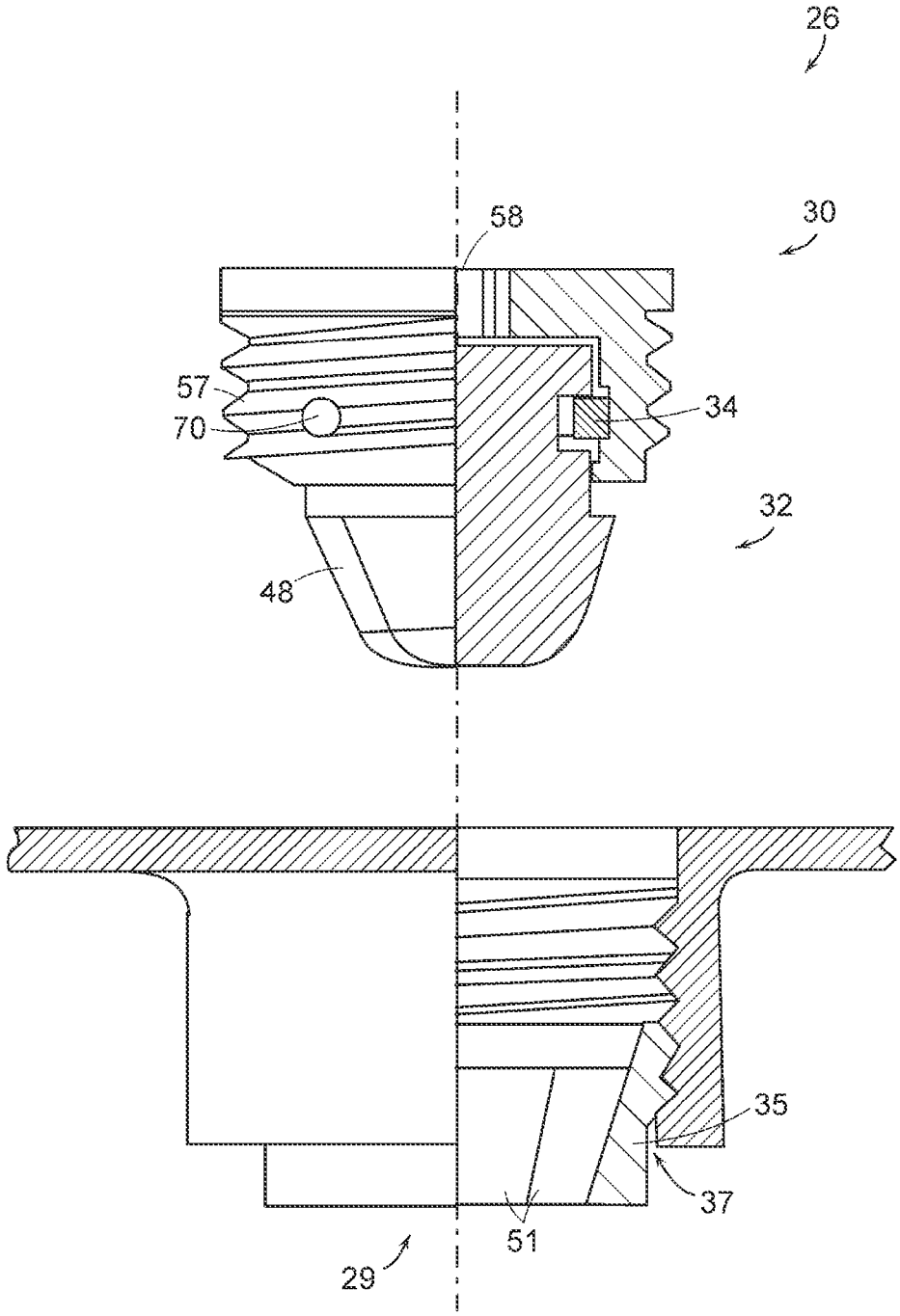

In another embodiment, illustrated in FIG. 3B, a partial weight receptacle 29 includes only a seat portion 35. Seat portion 35 includes an outer attachment feature 37 and a plurality of facets 51. In the present embodiment, outer attachment feature 37 is a threaded outer surface that engages a threaded bore in a club head. Weight receptacle 29 is configured to be threaded into the club head through the outer end of the threaded bore and the threaded bore is preferably threaded only along a portion of its length so that receptacle 29 is prevented from threading past an inner end of the threaded bore and becoming disengaged. The threaded bore of the club head is sized to engage the threaded outer surface of cap 30 of weight 26. As a result, when weight 26 is installed in the club head, cap 30 is coupled to the threaded bore and slug 32 is coupled to receptacle 29. A tool may be used to rotate weight receptacle 29 relative to the club head by engaging facets 51 of seat portion 35 or a separate tool engagement feature may be provided.

Figure 3C:
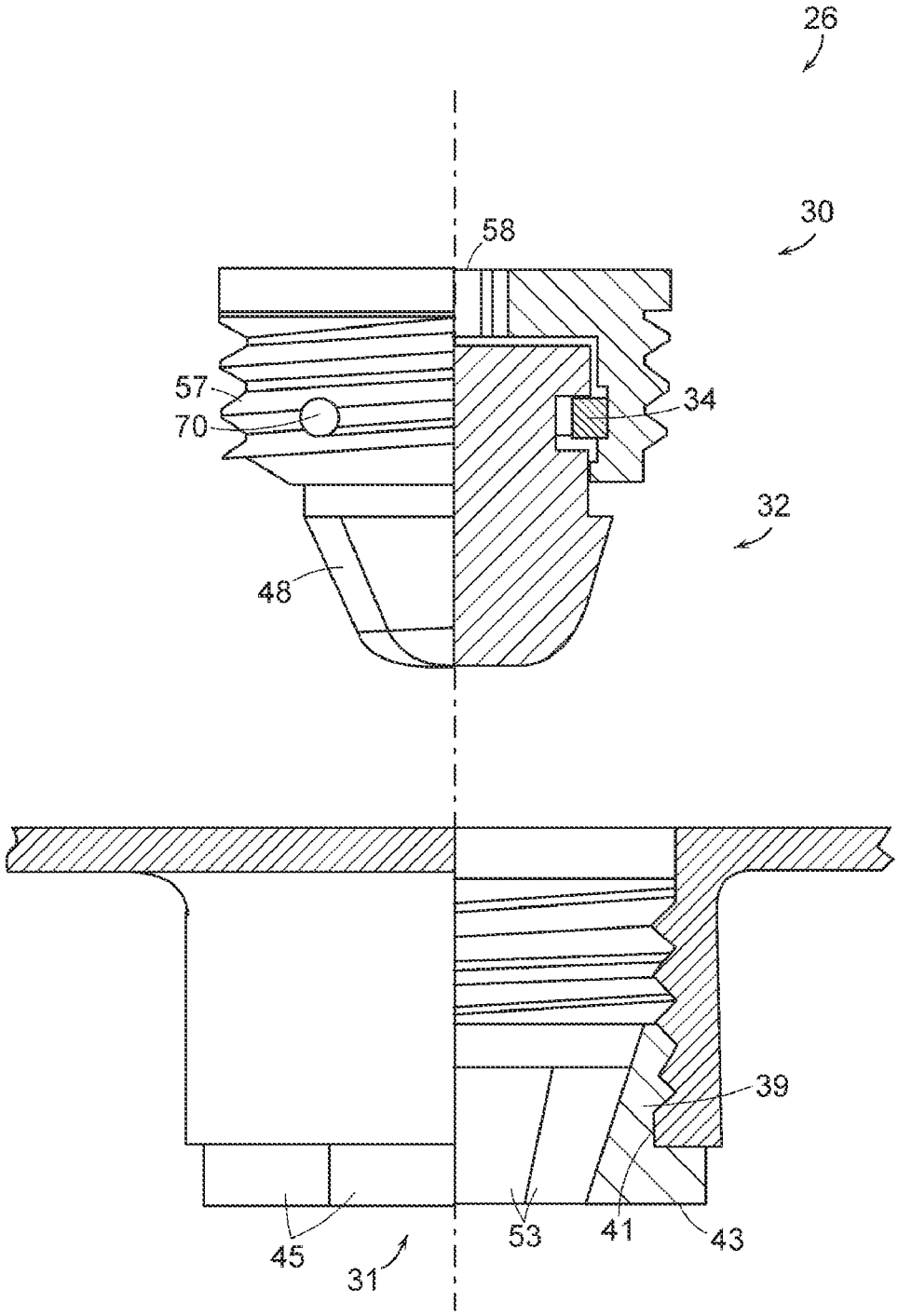

Another partial weight receptacle 31 includes only a seat portion 39, as shown in FIG. 3C. Seat portion 39 includes an outer attachment feature 41, a plurality of facets 53 and a travel limit flange 43. Outer attachment feature 41 is a threaded outer surface that engages a threaded bore in a club head. Weight receptacle 31 is configured to be threaded into the club head through the inner end of the threaded bore and flange 43 limits the engagement of weight receptacle 31 in the threaded bore. During manufacture, weight receptacle 31 would be installed in the club head prior complete assembly of the club head shell. For example, weight receptacle would be installed in the club head prior to attachment of a separate face insert or a separate crown piece. The threaded bore of the club head is sized to engage the threaded outer surface of cap 30 of weight 26. As a result, when weight 26 is installed in the club head, cap 30 is coupled to the threaded bore and slug 32 is coupled to receptacle 31. An optional tool engagement feature 45 may be included on weight receptacle 31 so that it may be threaded into the threaded bore. Tool engagement feature may be a plurality of facets disposed on flange 43 so that flange 43 is hexagonally shaped and sized to mate with a wrench, such as a socket wrench.

Figure 3D:
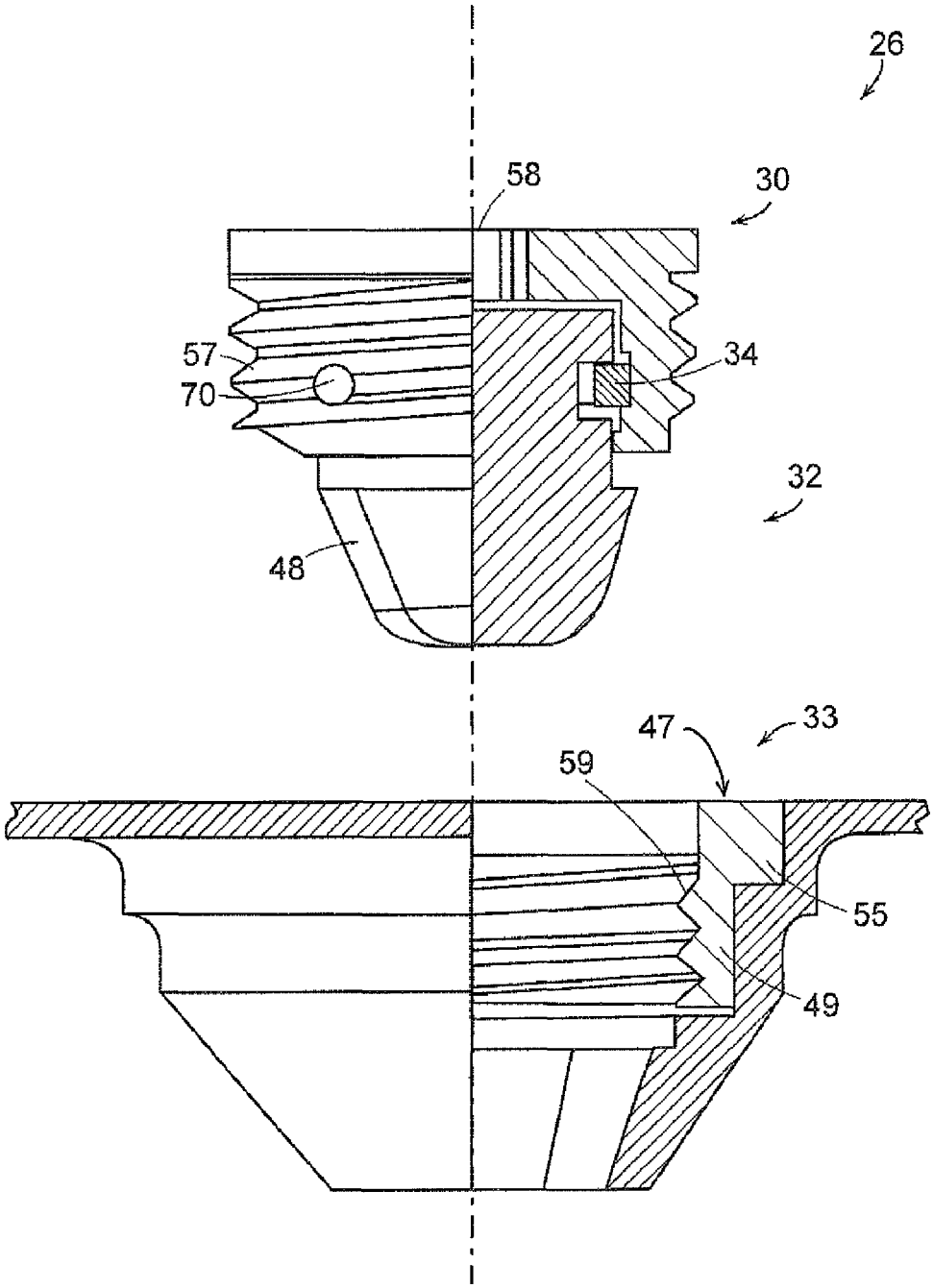

In a still further embodiment, a partial weight receptacle 33 includes only cap portion 47, as shown in FIG. 3D. Cap portion 47 includes a generally tubular cylindrical body member 49 and a travel limit flange 55. Receptacle 33 is inserted into a bore included in a club head and attached thereto. For example, receptacle 33 may be bonded, welded and/or staked, such as by dowel pins. Receptacle 33 includes a threaded inner surface 59 that is sized to engage the threaded outer surface of cap 30 of weight 26. In the present embodiment, the club head includes a seat portion including an anti-rotation feature that is preferably integrally cast with the remainder of the club head.

In embodiments utilizing a separate weight receptacle, the receptacle may be constructed from any metallic or non-metallic material. For example, the weight receptacle may be constructed of titanium, steel, aluminum, tungsten, and/or any alloys of those materials. Including a separate weight receptacle permits the use of materials different than the club head that may be selected to simplify manufacturing of the receptacle.

Weight 26 is assembled from a cap 30 and a weight slug 32 that are movably attached by retainer 34. Cap 30 and slug 32 are coupled so that they are able to rotate relative to each other about the longitudinal axis of weight 26. When weight 26 is installed in club head 10, cap 30 engages cap portion 40 of receptacle 28 and retains slug 32 within receptacle 28. Cap 30 also provides a cover for slug 32 so that when installed in golf club head 10 weight 26 has a desired appearance to a user regardless of the configuration of slug 32.

Figure 4:
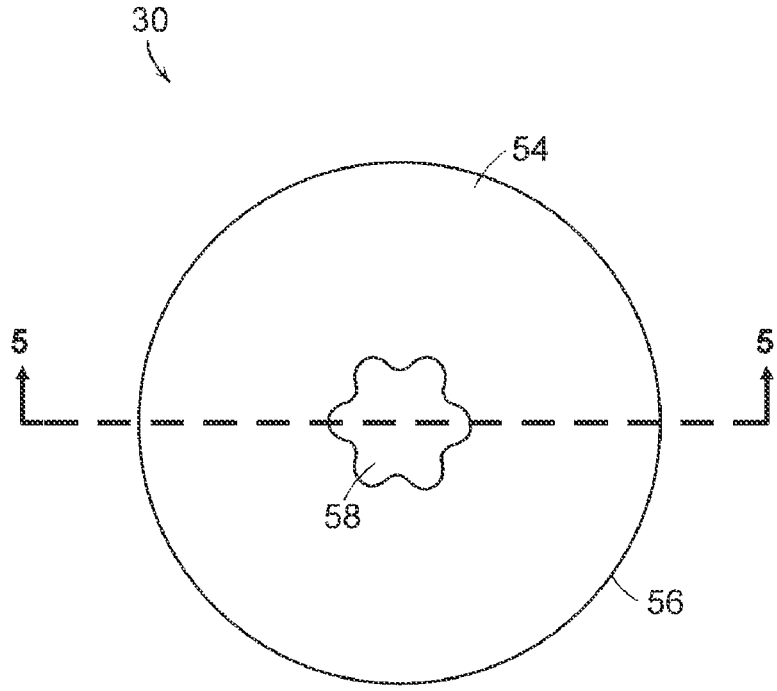
FIG. 4 is a side view of an embodiment of a cap that is included in the weight of FIGS. 3A-3D.
Figure 5:
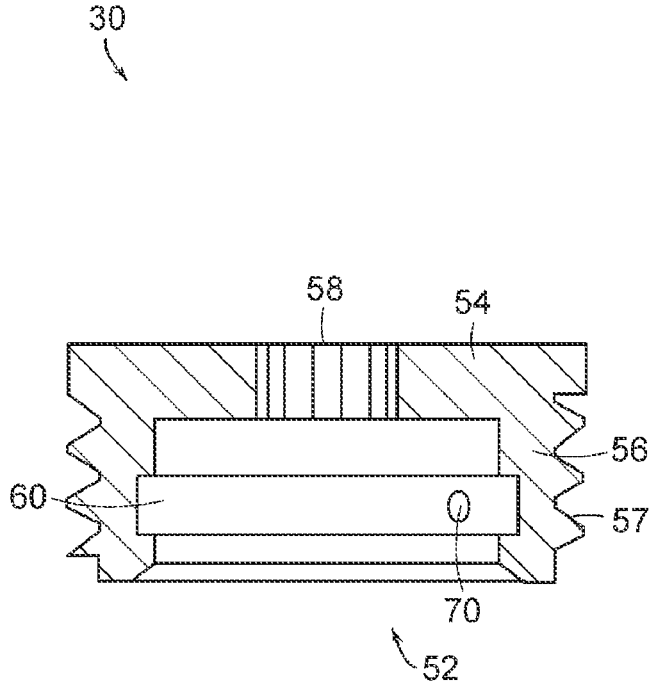
FIG. 5 is a cross-sectional view of the cap of FIG. 4.

Cap 30 is a cup-shaped member formed from a base 54 and side wall 56 that define a recess 52, as shown in FIGS. 3-5. Recess 52 receives at least a portion of slug 32 when weight 26 is installed in club head 10. Side wall 56 is a generally annular wall that extends away from base 54. Side wall 56 of cap 30 includes threaded outer surface 57 to mate with the threaded inner attachment feature 46 of receptacle 28. The length and diameter of side wall 56 are selected so that recess 56 may receive a portion of slug 32. Additionally, a retention feature 60 may be included in cap 30 so that slug 32 may be movably coupled to cap 30 so that relative rotation between cap 30 and slug 32 is permitted while relative translation is prevented in the assembled weight 26. In the present embodiment, retention feature 60 is a circumferential channel that extends into side wall 56 from the inner surface of side wall 56 and defines a retention flange 61 at an end of side wall 56 opposite base 54. It should be appreciated that the height of the channel may be as small as approximately equal to the height of retainer 34, as shown in FIG. 3, or as large as the distance from retention flange 61 to the surface of base 54 that forms the end of recess 52.

A tool engagement feature 58 is included in base 54 of cap 30. The tool engagement feature is a feature that mates with a tool manipulated by a user so that weight 26 may be installed or removed from receptacle 28. Tool engagement feature 58 is shaped and sized to mate with a complementary tool. For example, tool engagement feature 58 may be configured to receive a Torx-type wrench (as shown), a screw driver, a spanner wrench or any other standard or custom tool. Preferably, tool engagement feature 58 is configured to mate with a tool other than articles that are commonly carried by a golfer during a round of golf (e.g., coins, divot tools and golf tees).

Figure 6:
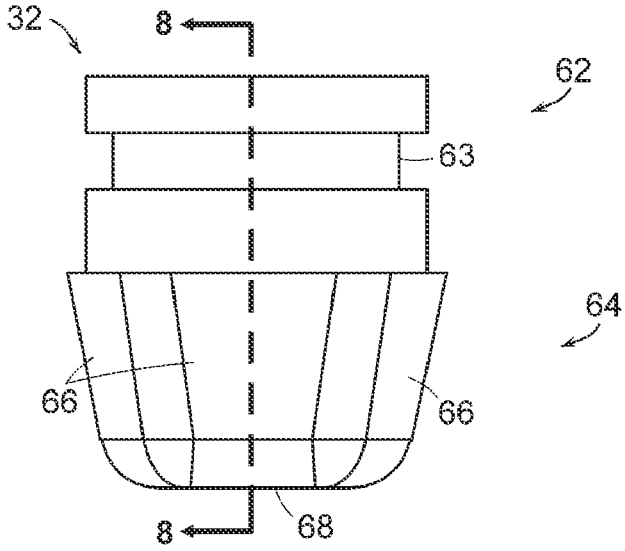
FIG. 6 is a side view of an embodiment weight slug that is included in the weight of FIGS. 3A-3D.
Figure 7:
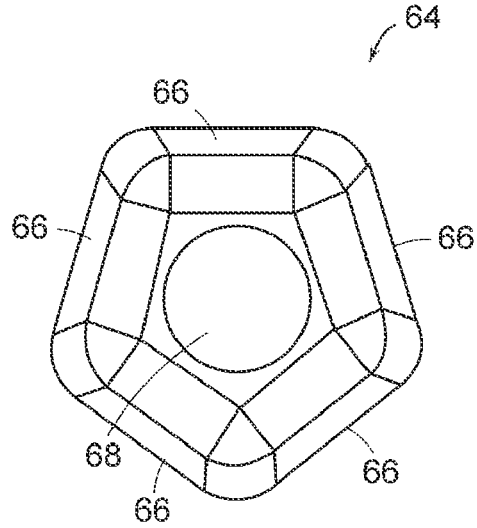
FIG. 7 is another side view of the weight slug of FIG. 6.
Figure 8:
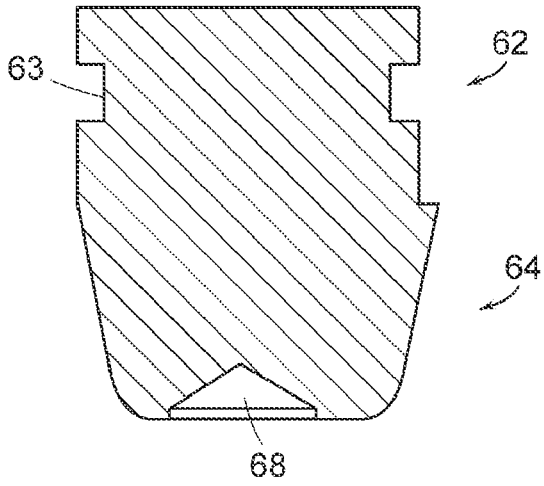
FIG. 8 is a cross-sectional view of the weight slug of FIG. 6.

Slug 32 is a mass member that is movably coupled to cap 30 in weight 26. Slug 32 is a generally elongate member that includes a retention portion 62 movably coupled to cap 30 and an extension portion 64 that includes anti-rotation feature 48, as shown in FIGS. 6-8. Retention portion 62 is a generally cylindrical portion of slug 32 that has an outer diameter that is less than the inner diameter of side wall 56 so that at least a portion of retention portion 62 is received within recess 56. Preferably, retention feature 60 of cap 30, retention portion 62 of slug 32 and retainer 34 are dimensioned so that when weight is installed in receptacle 28 retention portion 62 and base 54 of cap 30 are in forced abutment.

A retention feature 63 is included in retention portion 62 of slug 32 that allows slug 32 to be movably coupled to cap 30. In the present embodiment, retention feature 63 is a circumferential channel that extends into slug 32 from an outer surface of retention portion 62. In the assembled weight, a retainer 34 extends from cap 30 and into retention feature 63 and limits relative translation between slug 32 and cap 30 in the direction of the longitudinal axis of weight 26 so that slug 32 is prevented from fully disengaging from cap 30.

Extension portion 64 of slug 32 engages seat portion 42 of receptacle so that relative rotation between receptacle 28 and slug 32 is prevented when weight 26 is installed. In particular, extension portion 64 of slug 32 includes anti-rotation feature 48 that is generally tapered and has a polygonal cross-sectional shape formed by a plurality of tapered facets 66 that complement facets 50 of seat portion 42 of receptacle 28. For example, portion 64 of slug 32 includes a plurality of tapered facets so that the cross-sectional shape of portion 64 is pentagonal and complements the pentagonal cross-sectional shape of seat portion 42 of receptacle 28. It should be appreciated that although seat portion 42 of receptacle 28 is tapered, it should be appreciated that seat portion 42 need not be tapered, but instead may have constant cross-sectional shape and size that correspond to the shape and size of an intermediate location along extension 64.

The dimensions and material of slug 32 are selected to provide any desired mass for weight 26. Mass adjustment features 68 may be included in slug 32 to fine tune the mass of the member. For example, slug 32 includes a mass adjustment feature 68 that is a bore extending from an end of portion 64 opposite retention portion 62. It should be appreciated that the bore may be any depth so that any desired amount of material is removed to reduce the mass of slug 32. Additionally, although the bore is shown extending through slug 32 generally coaxial with the longitudinal axis of slug 32, it should be appreciated that the bore may have any desired orientation and multiple mass adjustment features may be included.

Figure 9:
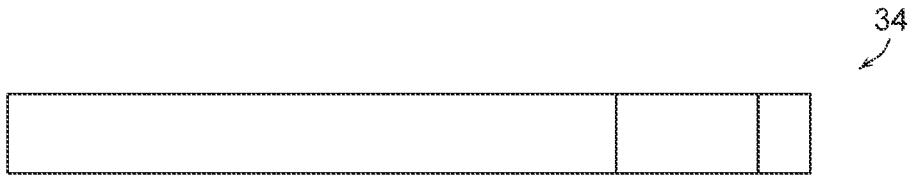
FIG. 9 is a side view of an embodiment of a retainer that is included in the weight of FIG. 3.
Figure 10:
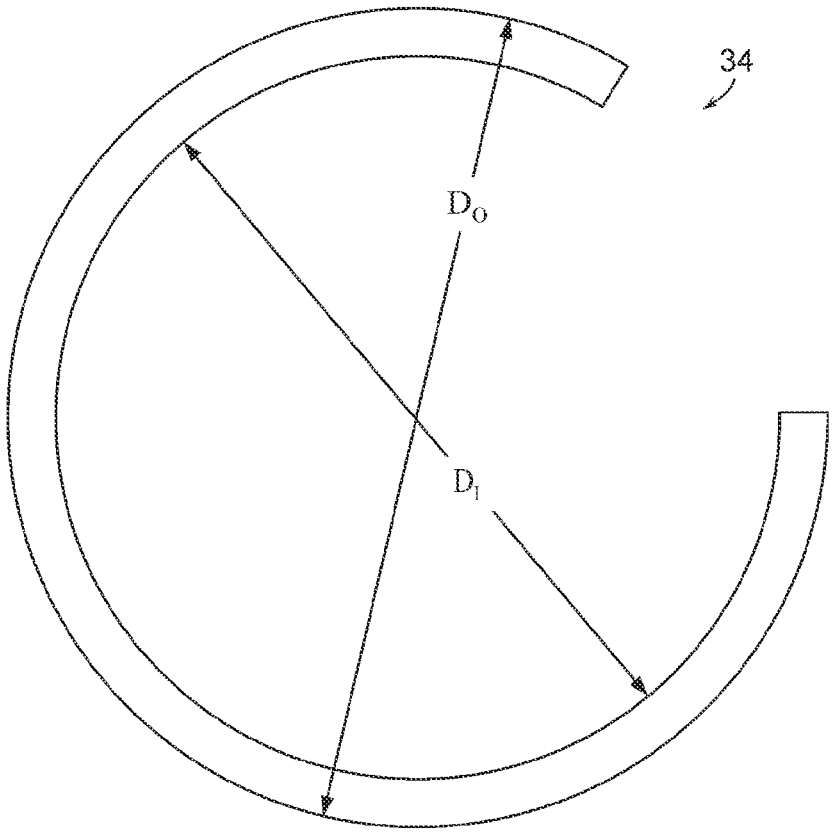
FIG. 10 is another side view of the retainer of FIG. 9.

Referring to FIGS. 9 and 10, retainer 34 included in the assembled weight 26 will be described. Retainer 34 is a spring clip in the form of a flexible, semi-circular annular member that is constructed so that it is capable of being elastically deformed between a first configuration and a second configuration. In the first configuration, retainer 34 has a first inner diameter $D_I$ that is approximately equal to the minimum diameter of the channel that forms retention feature 63 of slug 32 and a first outer diameter $D_O$ that is less than the inner diameter of side wall 56 of cap 30, and preferably approximately equal to the outer diameter of retention portion 62 of slug 32. In the second configuration, retainer has a second inner diameter $D_I$ that is less than the outer diameter of retention portion 62 of slug 32 and a second outer diameter $D_O$ that is greater than the inner diameter of wall 56 of cap 30.

In the assembled weight 26, retainer 34 is in the second configuration and is interposed between cap 30 and slug 32 and extends across a sliding interface between cap 30 and slug 32. During assembly, however, retainer 34 is deformed from the second configuration into the first configuration and is disposed within retention feature 63 so that it and retention portion 62 of slug 32 may be inserted into recess 56. Because retainer 34 is elastically deformed from the second configuration into the first configuration, when slug 32 and cap 30 are positioned so that retention features 60 and 63 align, retainer 34 springs back to the second configuration and extends across the interface between cap 30 and slug 32 to prevent relative translation therebetween. Cap 30 may also include one or more optional access bores 70 that extend generally radially through side wall 56 and intersect retention feature 60 so that weight 26 may be disassembled. For example, a plurality of rods may be inserted through bores 70 and pressed against the outer wall of retainer 34 so that retainer 34 may be deformed from the second configuration into the first configuration in the assembled weight 26. Deforming retainer 34 into the first configuration allows slug 32 to be separated from cap 30.

Cap 30, slug 32 and retainer 34 may be constructed from any desired materials to provide any desired weights. In an embodiment, cap 30 is constructed of aluminum, slug 32 is constructed of steel and retainer 34 is constructed of stainless steel and weight 26 has a total weight of approximately 8.3 grams. In another embodiment, cap 30 is constructed of aluminum, slug 32 is constructed of a tungsten alloy and retainer 34 is constructed of stainless steel and weight 26 has a total weight of approximately 13.1 grams. In these exemplary embodiments, the density of the material used to construct slug 32 is greater than the material used to construct cap 30, but it should be appreciated that the cap and slug may be constructed from the same material or the slug may be constructed from a material having a density that is less than the density of a material used to construct the cap.

As described above, the weight slug includes an extension and an anti-rotation feature that is configured to complement a seat portion of the receptacle. For example, slug 32 includes extension portion 64 that has a generally pentagonal cross-sectional shape. Additional embodiments of an extension portion of the slug are that also provide an anti-rotation feature are illustrated in FIGS. 11-14.

Figure 11:
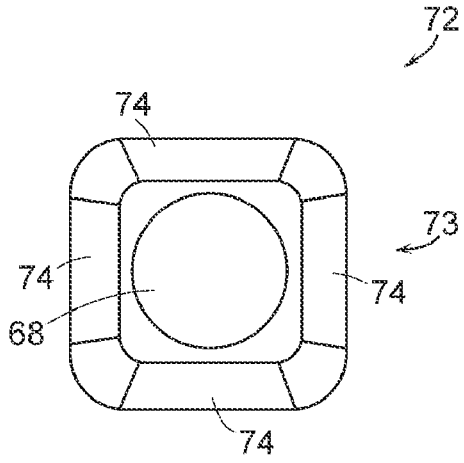
FIG. 11 is a side view of another embodiment of a weight slug.
Figure 12:
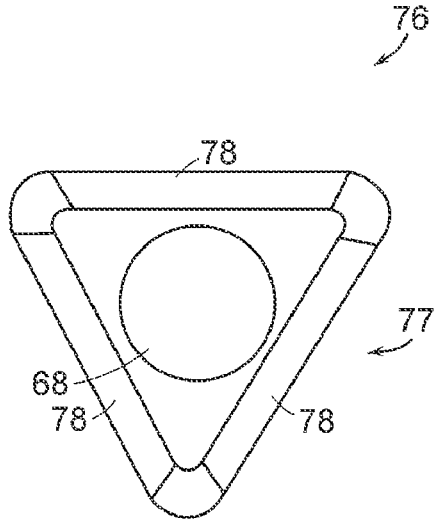
FIG. 12 is a side view of a further embodiment of a weight slug.
Figure 13:
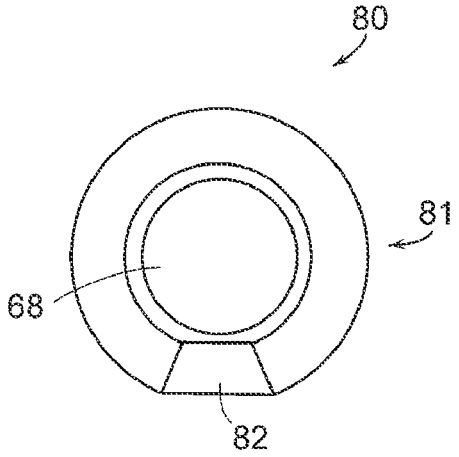
FIG. 13 is a side view of a still further embodiment of a weight slug.
Figure 14:
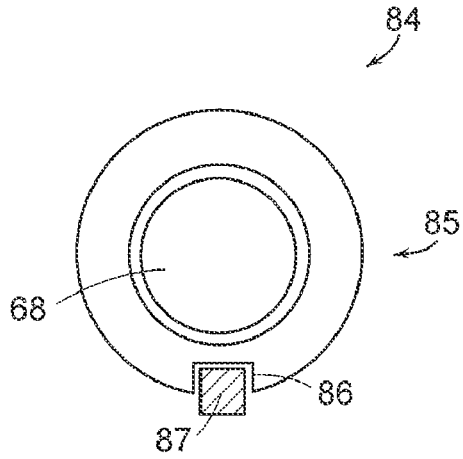
FIG. 14 is a side view of another embodiment of a weight slug that includes a separate anti-rotation member.

Referring first to FIG. 11, slug 72 includes an extension 73 that is tapered and has a square cross-sectional shape so that it defines a plurality of tapered facets 74. In another embodiment, shown in FIG. 12, a slug 76 includes an extension 77 that is tapered and has a triangular cross-sectional shape so that it defines three tapered facets 78. In another embodiment, illustrated in FIG. 13, slug 80 includes an extension 81 that is generally shaped as a truncated cone. Slug 80 further includes a single facet 82 that acts as an anti-rotation feature when mated with the seat portion of a receptacle having a complementary cross-sectional shape. Referring to FIG. 14, slug 84 includes an extension 85 that is also shaped as a truncated cone, but instead of a facet, extension 85 includes keyway 86 that is sized and shaped to receive a separate anti-rotation member 87. In such an embodiment, the receptacle also includes a channel that aligns with keyway 86 to allow insertion of anti-rotation member 87. Although each of the previously described embodiments is illustrated with mass adjustment feature 68, it should be appreciated that the feature may be omitted if desired. It should further be appreciated that the seat portions of corresponding receptacles may be tapered or straight-walled.

Figure 15:
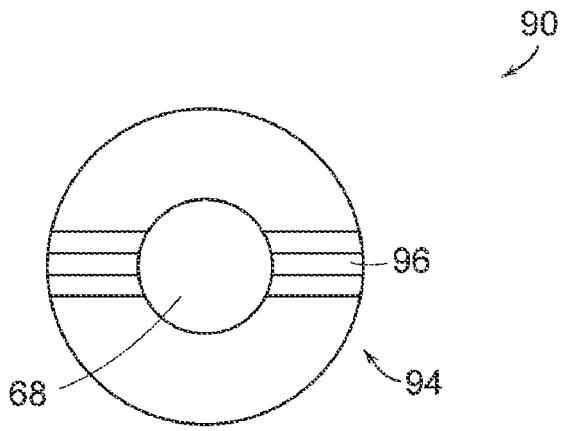
FIG. 15 is a side view of another embodiment of a weight slug.
Figure 16:
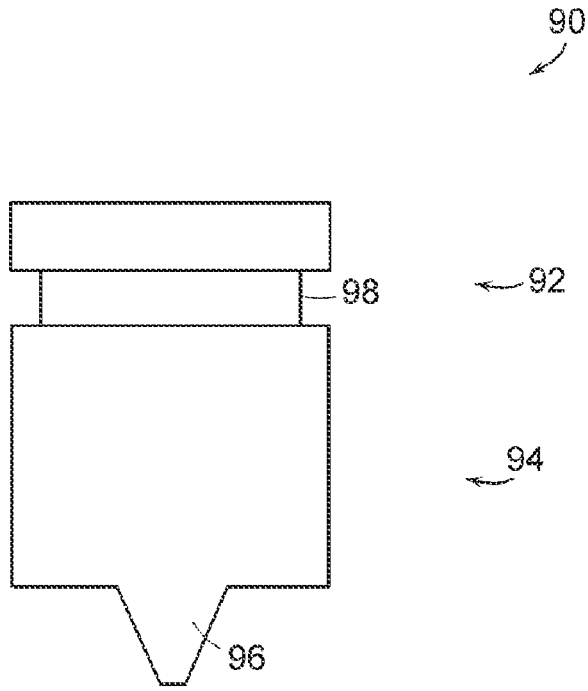
FIG. 16 is another side view of the weight slug of FIG. 15.

Referring to FIGS. 15 and 16, another embodiment of the weight slug will be described. Slug 90 is a mass member that is configured to be movably coupled to a cap of a weight assembly, such as cap 30 of weight 26. Slug 90 includes retention portion 92 and extension portion 94. Similar to the previously described embodiments, retention portion 92 is configured to be removably coupled to a cap, and includes a retention feature 98 that is a channel configured to receive a portion of a retainer.

Extension portion 94 is a generally cylindrical portion that includes an anti-rotation feature 96. In the present embodiment, anti-rotation feature 96 is a tapered rib that extends diametrically across an end of extension portion 94. It should be appreciated that anti-rotation feature 96 is configured to engage a diametric slot included in a corresponding receptacle. For example, a slot having a width that is between the maximum and minimum widths of the tapered rib may be provided or a tapered slot may be provided. Furthermore, slug 90 includes an optional mass adjustment feature 68 that is a bore extending from an end of extension portion 94 opposite retention portion 92.

Figure 17:
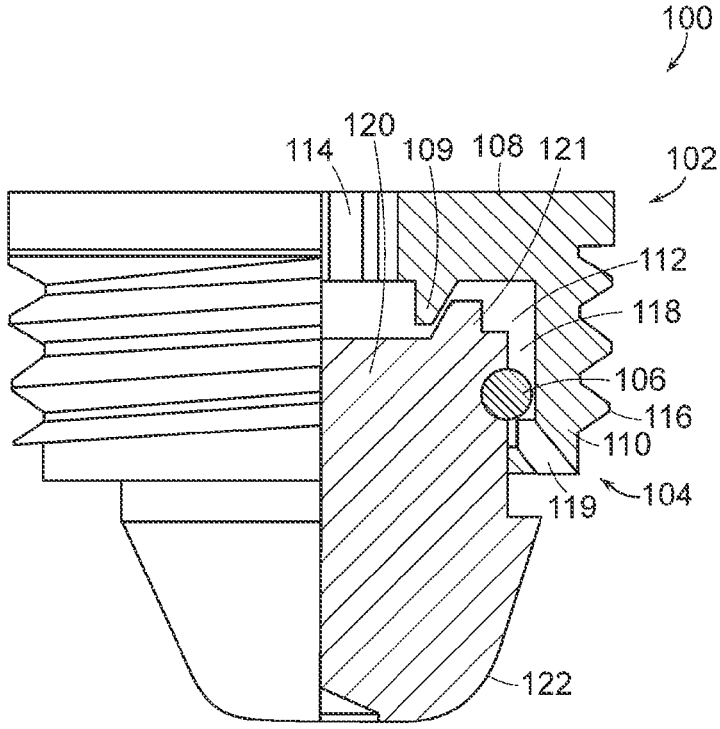
FIG. 17 is a partial cross-sectional view of another embodiment of a weight in accordance with the present invention.
Figure 18:
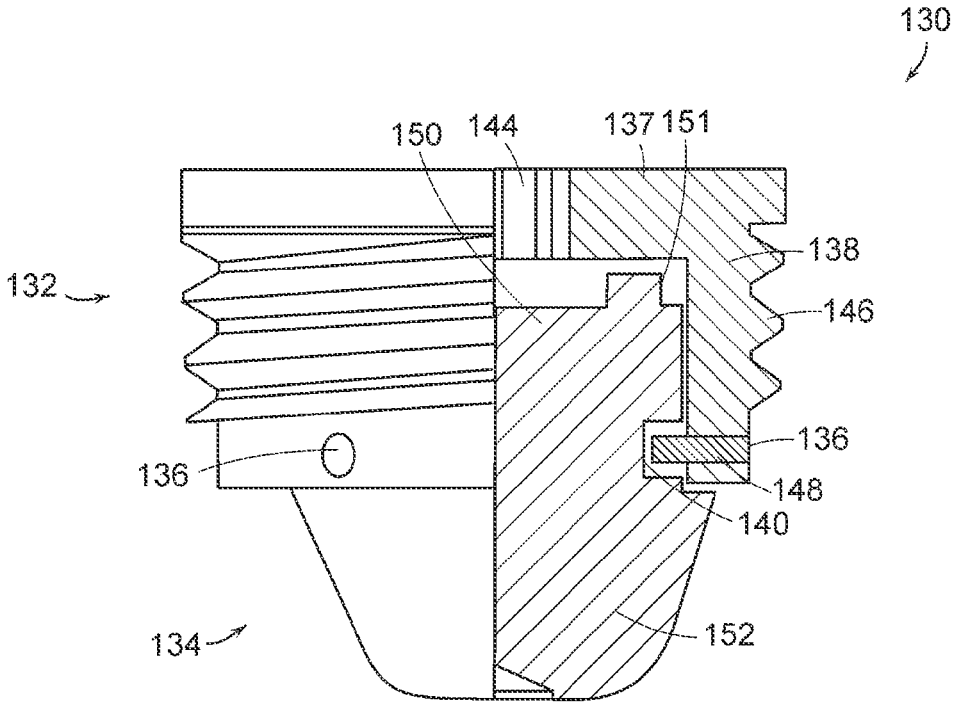
FIG. 18 is a partial cross-sectional view of another embodiment of a weight.

The retainer used to movably couple the cap and slug may have any configuration that allows relative rotation between the cap and slug while preventing the slug from fully disengaged in a recess provided in the cap. Other embodiments of the assembled weight including different retainers are illustrated in FIGS. 17 and 18. Referring first to FIG. 17, weight 100 includes a cap 102, a slug 104 and a retainer 106. Retainer 106 of weight 100 is a deformable ring that is a complete circular annulus constructed from a deformable material and that extends across a sliding interface between cap 102 and slug 104. Cap 102 includes a base 108 and side wall 110 that extends from base 108 to define a recess 112. Base 108 includes a tool engagement feature 114 that allows weight 100 to be installed in or removed from a corresponding receptacle. Side wall 110 includes an attachment feature, such as a threaded outer surface 114, for coupling cap to a receptacle, and a retention feature 118 for movably coupling cap 102 and slug 104.

Retention feature 118 is a channel that has a height that is approximately as large as the distance from a retention flange 119 to the surface of base 108 that forms the end of recess 112. As a result, when weight 100 is installed in a corresponding receptacle, a retention portion 120 of slug 104 is pressed against base 108 of cap 102. To reduce the surface area contact between retention portion 120 of slug 104 and base 108 of cap 102, bearing features may be included on the respective components. In particular, a projection 109 extends from base 108 toward retention portion 120 and a complementary projection 121 extends from retention portion toward base 108. Projections 109 and 121 are preferably annular and include tapered contact surfaces that abut and slide against each other as weight 100 is installed in a receptacle. Projections may be include on one or both of the cap and slug to provide a reduced contact surface area. Alternatively, a separate bearing feature may be included to reduce the contact surface area, such as a rigid or compressible annular ring interposed between base 108 and retention portion 120.

Slug 104 includes retention portion 120 and extension portion 122. Retention portion 120 extends into recess 112 of cap 102 and is used to retain slug 104 with cap 102 so that the components are free to rotate relative to each other while preventing full disengagement of slug 104 from cap 102. As described in previous embodiments, extension portion 122 extends from retention portion 120 and engages a seat portion of a corresponding receptacle when weight 100 is installed in a club head. The configuration of extension portion 122 is substantially identical to those previously described.

Retention portion 120 includes a retention feature 124 that receives a portion of deformable retainer 106 so that retainer 106 is held in place on slug 104. For example, retention feature 124 of the present embodiment is a circumferential channel that extends generally radially into slug 104 from an outer surface of retention portion 120.

Weight 100 is assembled by installing retainer 106 in retention feature 124. Then retention portion 120 and retainer 106 are inserted into recess 112. When retainer 106 is pressed against retention flange 119, it is forced to deform. The inner dimension of retention flange 119 is selected so that it is greater than a deformed outer dimension of retainer 106, but smaller than the free outer dimension of retainer 106 so that as retainer 106 deforms it is able to slide past retention flange 119 and into retention feature 118. After the deformed retainer 106 passes by retention flange 119, it is free to deform back to the free outer dimension. Because the inner dimension of retention flange 119 is smaller than the free outer dimension of retainer 106, retention portion 120 of slug 104 is retained in recess 112 of cap 102.

Another embodiment of the weight is illustrated in FIG. 18. Weight 130 includes a cap 132, a slug 134 and a retainer 136. In the present embodiment, retainer 136 is a member that extends through a side wall 138 of cap 132, across the interface between cap 132 and slug 134, and into a retention feature 140 of slug 134.

Similar to previous embodiments, cap 132 includes a base 137 and side wall 138 that extends from base 137 to define a recess 142. Base 137 includes a tool engagement feature 144 that allows weight 130 to be installed in or removed from a corresponding receptacle. Side wall 138 includes an attachment feature, such as a threaded outer surface 146, for coupling cap to a receptacle, and a retention feature 148 for movably coupling cap 132 and slug 134. In the present embodiment, a single annular projection 151 is incorporated that extends from retention portion 150 toward base 137 of cap 132 to reduce contact surface area between retention portion 150 and base 137.

Retention feature 148 is a bore that extends through side wall 138. Retention feature 148 is sized and shaped to receive retainer 136, which is an elongate member such as a dowel pin or set screw. The length of retainer 136 is selected so that it extends through side wall 138 and into retention feature 140 of slug. The size and shape of retention feature 148 is selected according to the configuration of retainer 136. For example, in embodiments utilizing a dowel pin as retainer 136, the diameter of retention feature 148 is selected so that the dowel pin is captured in retention feature 148 by a press, or interference fit. In other embodiments utilizing a set screw as retainer 136, retention feature 148 is a threaded bore sized to threadably engage the set screw. It should be appreciated that any number of retainers 136 may be included that extend through side wall 138. Additionally, it should be appreciated that retention feature 148 may be configured so that retainer 136 extends through side wall radially or at any angle. For example, retention feature 148 may be configured so retainer 136 extends toward slug 134 approximately normal to retention feature 140 of slug 134. In another example, retention feature 148 may be configured so retainer 136 extends toward slug 134 so that it is approximately tangent to retention feature 140 of slug 134.

Slug 134 includes retention portion 150 and extension portion 152. Retention portion 150 extends into recess 142 of cap 132 and is used to retain slug 134 with cap 132 so that the components are free to rotate relative to each other while preventing full disengagement of slug 134 from cap 132. As described in previous embodiments, extension portion 152 extends from retention portion 150 and engages a seat portion of a corresponding receptacle when weight 130 is installed in a club head. The configuration of extension portion 152 is substantially identical to those previously described.

Retention portion 150 includes a retention feature 140 that receives a portion of retainer 136 in the assembled weight 130. Retention feature 140 of the present embodiment is a circumferential channel that extends generally radially into slug 134 from an outer surface of retention portion 150.

Weight 130 is assembled by inserting retention portion 150 of slug 134 into recess 142 of cap 132. Retention portion 150 is inserted to a position in which retention feature 140 of slug 134 is aligned with retention feature 148 of cap 132. Retainer 136 is then inserted through retention feature 148 and into retention feature 140.

Figure 19:
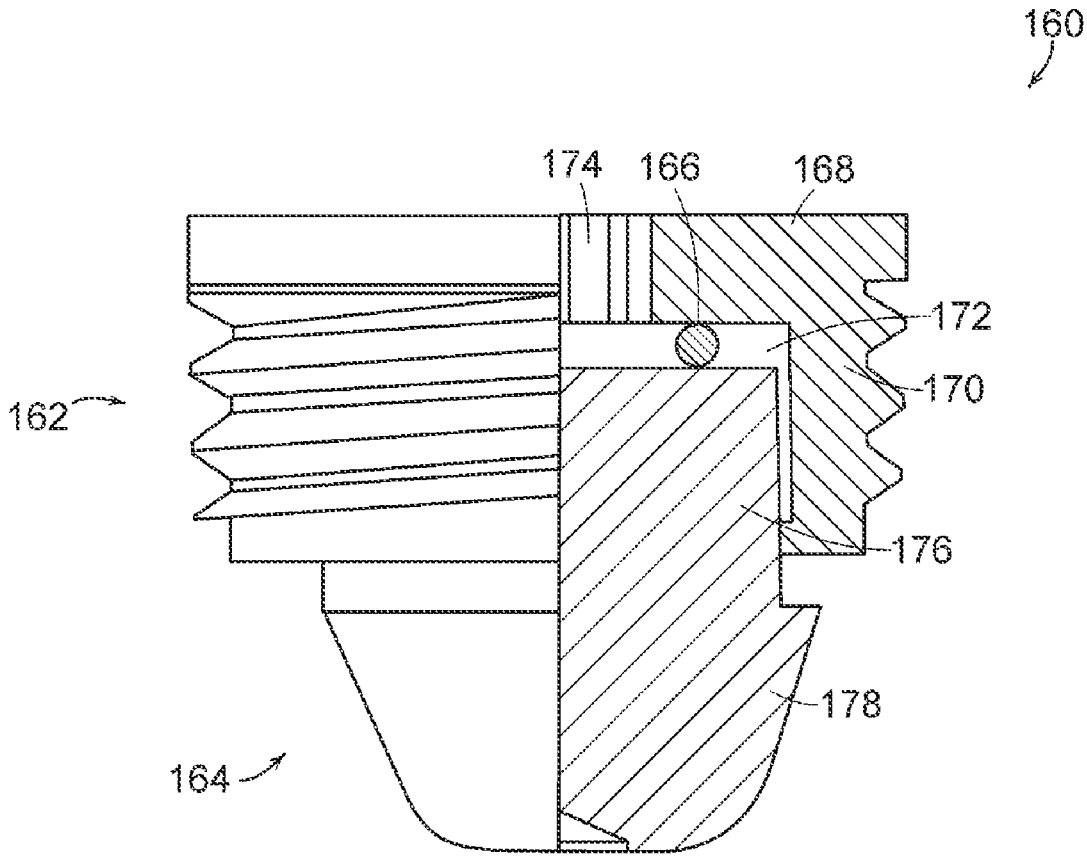
FIG. 19 is a partial cross-sectional view of a further embodiment of a weight.

In another embodiment, shown in FIG. 19, weight 160 includes cap 162, slug 164 and compression member 166. Cap 162 includes a base 168 and side wall 170 that extends from base 168 to define a recess 172. Base 168 includes a tool engagement feature 174 that allows weight 160 to be installed in or removed from a corresponding receptacle.

Slug 164 includes retention portion 176 and extension portion 178. Retention portion 176 extends into recess 172 of cap 162 and retains slug 164 in coaxial alignment with cap 162 during installation into a corresponding receptacle. Retention portion 176 is configured so that the components are free to rotate relative to each other during installation. As described in previous embodiments, extension portion 178 extends from retention portion 176 and engages a seat portion of a corresponding receptacle when weight 160 is installed in a club head. The configuration of extension portion 178 is substantially identical to those previously described.

Compression member 166 is included in weight 160 that is disposed between base 168 of cap 162 and retention portion 176 of slug 164. Compression member 166 is an elastic member that is compressed when weight 160 is installed in a receptacle so that extension portion 178 of slug 164 is pressed into a seat portion of the receptacle. Compression member 166 may have any desired shape, for example, compression member 166 may be disk-shaped or annular, as shown in FIG. 19.

Weight 160 is assembled by inserting compression member 166 into recess 172 of cap 162 and then inserting retention portion 176 of slug 164. The weight 160 is then inserted into a receptacle and cap 162 is engaged with a cap portion of the receptacle until compression member 166 is compressed a desired amount to place a selected preload on slug 164.

Although the inventive weight is illustrated in a wood-type golf club, it should be appreciated that the weight may be incorporated in any type of golf club. For example, the inventive weight may be included in drivers, fairway woods, utility clubs, hybrids, iron-type golf clubs, wedges and putters.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A removable weight for a golf club head including a receptacle, comprising:

a cap including a base, and a sidewall that extends from the base to define a recess, wherein the side wall includes an outer surface that is removably coupled to the receptacle;

a slug including a retention portion and an extension portion, wherein at least a portion of the retention portion is slidably disposed in the recess, and the extension portion includes an anti-rotation feature that engages the receptacle to prevent relative rotation between the receptacle and the slug; and a retainer disposed between the cap and the slug, wherein the retainer is configured to prevent the retention portion of the slug from disengaging the recess of the cap when the cap is uncoupled from the receptacle, and wherein the cap and the slug rotate relative to each other, wherein the extension portion is tapered such that the extension portion directly abuts a portion of the receptacle when the weight is received therein.

2. The weight of claim 1, wherein the extension includes at least one planar facet.

3. A golf club head, comprising:

a body including a receptacle, wherein the receptacle includes a cap portion and a seat portion and wherein the cap portion is disposed proximate an outer surface of the body and the seat portion is spaced from the outer surface of the body by the cap portion;

a weight comprising a cap, a slug and a retainer, wherein the cap includes a base and a sidewall that extends from the base to define a recess, and the side wall includes an outer surface that is removably coupled to the cap portion of the receptacle, wherein the slug includes a retention portion and an extension portion, at least a portion of the retention portion is slidably disposed in the recess, and the extension portion includes an anti-rotation feature that engages the seat portion of the receptacle to prevent relative rotation between the receptacle and the slug, and wherein the retainer is disposed between the cap and the slug, wherein the retainer is configured to prevent the retention portion of the slug from disengaging the recess of the cap when the cap is uncoupled from the receptacle, and wherein the cap and the slug rotate relative to each other.

4. The golf club head of claim 3, wherein the retainer is a spring clip configured as a semi-circular annular member constructed to be elastically deformed radially.

5. The golf club head of claim 3, wherein the receptacle is an integral component of the body.

6. The golf club head of claim 3, wherein the receptacle is a separate component that is attached to the body.

7. The golf club head of claim 3, wherein the weight further comprises a retainer that extends across a sliding interface between the cap and the slug.

8. The golf club head of claim 3, wherein the seat portion of the receptacle includes an opening having a polygonal shape.

9. The golf club head of claim 3, wherein the seat portion of the receptacle includes a tapered opening.

10. The golf club head of claim 3, wherein the seat portion includes at least one facet.

11. The golf club head of claim 3, wherein the inner surface of the cap portion of the receptacle is threaded, the outer surface of the side wall of the cap is threaded and the cap is threadably engaged with the cap portion.

12. A golf club head, comprising:

a body including a receptacle, wherein the receptacle includes a threaded cap portion and a seat portion; and a weight comprising a threaded cap, a slug and a retainer, wherein the cap includes a base and a sidewall that extends from the base to define a recess, and the cap is threadably coupled to the cap portion of the receptacle, wherein the slug includes a retention portion and an extension portion, at least a portion of the retention portion is slidably disposed in the recess, the extension portion includes an anti-rotation feature that engages the seat portion of the receptacle to prevent relative rotation between the receptacle and the slug, and the retainer extends across a sliding interface between the cap and the slug, and wherein the retainer is disposed between the cap and the slug, and is configured to prevent the retention portion of the slug from disengaging the recess of the cap when the cap is uncoupled from the receptacle, and the cap and the slug rotate relative to each other.

13. The golf club head of claim 12, wherein the retainer is a spring clip configured as a semi-circular annular member constructed to be elastically deformed radially.

14. The golf club head of claim 13, wherein the cap is constructed from a material having a first density, the slug is constructed from a material having a second density and the second density is greater than the first density.

* * * * *